US007198215B2

(12) United States Patent
Everson

(10) Patent No.: US 7,198,215 B2
(45) Date of Patent: Apr. 3, 2007

(54) DUAL PRODUCT SIZING MACHINE

(75) Inventor: Gary David Everson, Richlands (AU)

(73) Assignee: Oldenburg Australasia Pty Ltd (AU)

( * ) Notice: Subject to any disclaimer, the term of this patent is extended or adjusted under 35 U.S.C. 154(b) by 338 days.

(21) Appl. No.: 10/497,418

(22) PCT Filed: Nov. 22, 2002

(86) PCT No.: PCT/AU02/01581

§ 371 (c)(1),
(2), (4) Date: Oct. 26, 2004

(87) PCT Pub. No.: WO03/045561

PCT Pub. Date: Jun. 5, 2003

(65) Prior Publication Data

US 2005/0077406 A1 Apr. 14, 2005

(30) Foreign Application Priority Data

Nov. 27, 2001 (AU) ..... PR9126

(51) Int. Cl.
*B02C 1/08* (2006.01)
*B02C 7/00* (2006.01)
*B02C 13/00* (2006.01)

(52) U.S. Cl. ..... 241/242; 241/158; 241/235

(58) Field of Classification Search ..... 241/158, 241/235, 135, 136, 242
See application file for complete search history.

(56) References Cited

U.S. PATENT DOCUMENTS 4,971,260 A * 11/1990 Taylor ..... 241/89.3
5,312,056 A * 5/1994 Kastingschafer et al. ... 241/235
5,823,452 A * 10/1998 Ballew et al. ..... 241/225

FOREIGN PATENT DOCUMENTS

SU 1301486 A 4/1987
SU 1447399 A 12/1988
SU 1766506 A 7/1992

* cited by examiner

*Primary Examiner*—Bena Miller
(74) *Attorney, Agent, or Firm*—Buchanan Ingersoll & Rooney PC

(57) ABSTRACT

A crushing machine comprises a pair of crushing rolls which are designed to be rotatable towards each other and away from each other. A side plate is provided on the outside of each roll. The crushing rolls have teeth which are shorter than conventional crushing teeth. The teeth on each roll are aligned with each other to provide cavities in which the crushing can occur. Rotation of the crushing rolls towards each other provides a centre sizing action to crush material (e.g. coal) into a larger particle size. Rotation of the crushing rolls away from each other provides a side sizing action to crush material between the roll and the side plates to a smaller particle size. Thus, the machine can crush material into two distinctly different particle sizes without any modification being required to the machine, the dual sizing occurring by reversing the rotation of the rolls.

14 Claims, 3 Drawing Sheets

DUAL PRODUCT SIZING MACHINE

FIELD OF THE INVENTION

This invention is directed to a dual product sizing machine which comprises a pair of crushing rolls and where the rolls can crush material to a first product size by passing the material between the crushing rolls when the rolls rotate towards each other, and where the rolls can crush material to a second product size by passing material between one of the crushing rolls and a slide plate when the rolls rotate away from each other. In this manner, a single machine can be used to provide product of two different sizes.

BACKGROUND ART

Machines to crush solid material such as coal, rock and the like are very well known. These machines typically comprise a pair of crushing rolls. These rolls are formed with peripheral crushing teeth. The rolls are spaced apart and rotate towards each other. The solid material passes between the rolls and is crushed to a desired particle size depending, inter alia, on the spacing between the rolls, the size of the teeth and the like.

In these known crushing arrangements, the teeth on one roll are offset with respect to the teeth on the other roll such that the tooth on one of the rolls passes between adjacent teeth on the other roll. This allows a good crushing action to be obtained.

A disadvantage with this type of machine is that product can only be crushed to one size or one size range. Should it be necessary to have product of a different size or size range, it is necessary to provide a separate machine. Alternatively, the rolls need to be adjusted to change the spacing between the rolls. It should be appreciated that adjustment of large and heavy rolls is not an easy task, and it is generally uneconomical to have a number of different machines to provide product of different sizes.

It is known to crush product by a "side sizing" method. These side sizing machines are fairly specialised in design and also crush to a single size. Side sizing requires a single roll and some sort of side plate with the material passing between the single roll and the side plate. The teeth on the roll need to be relatively short and "stubby" in order to provide a good crushing action. This requires a special roll as normal crushing rolls usually have teeth that are much larger.

OBJECT OF THE INVENTION

The present invention is directed to a machine that can crush material into two separate sizes using a centre sizing action to provide material of one size and a side sizing action to provide material of a second size, but where it is not required to change the rolls, the roll teeth etc.

It is an object of the invention to provide a machine that may at least partially overcome the abovementioned disadvantages or provide the public with the useful or commercial choice.

In one form, the invention resides in a dual product sizing machine, the machine comprising a pair of crushing rolls, the rolls being rotatable towards each other and away from each other (i.e. clockwise and anticlockwise), each roll being provided with an array of teeth, and a side sizing plate which is positioned adjacent the outer side of at least one of the crushing rolls, whereby rotation of the rolls towards each other allows material to pass between the rolls to be crushed to a first size, and rotation of the rolls away from each other allows material to pass between at least one of the rolls and the side plate to be crushed to a second size.

In this manner, a single machine can be used to provide two different products (that is material crushed to 2 different sizes) in such a manner where all that is required is to change the direction of rotation of the rolls and optionally to adjust the position of the side sizing plate. Thus, there is no requirement to change the rolls or have two separate machines.

The pair of crushing rolls may be of any convenient size. Typically, the crushing rolls have a length of between 1–3 m, and a diameter of between 500–1000 mm. The crushing rolls may comprise a shell that is fitted to a central body, this type of arrangement being known. Typically, the shell is in the form of separate segments that are annular and typically have a width of between 200–300 mm. Thus, a crushing roll can be made up of a number of such segments in a side-by-side relationship. This arrangement is known.

The rolls are mounted for rotation by any suitable method and are driven by any suitable drive means. Typically, both rolls are driven although under certain circumstances one of the rolls may be driven and the other of the rolls may be an idler roll.

The rolls may rotate at approximately 100–300 RPM and preferably rotate at approximately 180 RPM.

The crushing rate between the rolls may be between 100–1000 tonnes per hour, and typically approximately 500 tonnes per hour although this can vary to suit.

Each roll is provided with crushing teeth. It is preferred that the crushing teeth are identical on each roll. The crushing teeth are preferably designed to function efficiently in a centre crushing action (between the crushing rolls) and in a side crushing action (between a roll and the side plate). For this reason, it is preferred that the teeth are relatively stubby and are shorter than those used on conventional centre crushing rolls. A typical tooth length will be between 10–20 mm and typically approximately 15 mm.

To provide distinctly different product sizes between centre crushing and side crushing, it is preferred that the rolls are positioned such that the teeth on one of the rolls are in line with the teeth on the other roll during centre crushing. This allows product to be sized in a "cavity" defined between the pairs of teeth. By defining these "cavities" product can be sized to a larger size.

This is in contrast with conventional centre crushing rolls where the rolls are positioned such that the teeth on one roll pass between adjacent teeth on the other roll but do not align with the teeth on the other roll. This provides product having a similar size because the teeth on conventional rolls are longer but because the teeth pass between adjacent teeth on the other roll the "cavity" is similar to that defined by the aligned teeth of the rolls which form part of the present invention.

The machine includes at least one side plate. Suitably, a pair of side plates are provided with a side plate being positioned along the outer wall of each roll. The side plates can comprise elongated plate members. Suitably, the side plates are mounted for movement towards and away from the respective roll. Thus, for a centre sizing action, the side plates can be moved slightly away from the rolls as they are not required, while for the side sizing action, the side plates can be moved towards the roll to allow material to be crushed between the roll and the side plate. Hydraulic rams etc can be used to control the side plates although other types of control devices are also envisaged.

Material passing between a roll and a side plate is crushed to a particle size that is smaller than the material passing between the rolls. This is due to the shorter stubby teeth of the crushing roll. The shorter stubby teeth are preferred for side crushing as the side plate generally does not contain any teeth and therefore the "cavity" is formed between an adjacent pair of teeth on the roll and the face of the side plate, and this cavity will be smaller than the cavity formed between the aligned teeth of the rolls during centre crushing.

Suitably, the side plate comprises at least one member that may comprise one or more wear blocks and which function to provide an edge to promote sizing.

It is found that the machine according to the invention can crush material to a size of approximately 40 mm during centre crushing, and a smaller size of approximately 25 mm during side crushing. This can of course vary to suit.

BRIEF DESCRIPTION OF THE DRAWINGS

An embodiment of the invention will be described with reference to the following figures.

BEST MODE

Figure 1:
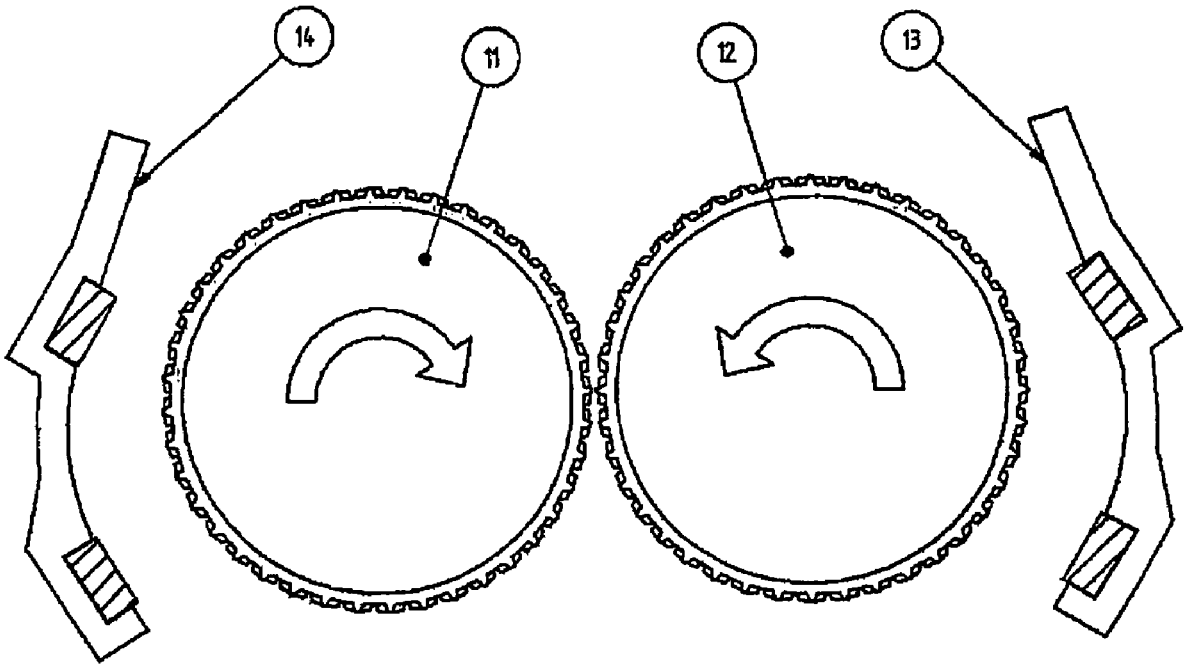
FIG. 1. Illustrates a pair of crushing rolls moving towards each other for a centre crushing operation.

Referring to the drawings and initially to FIG. 1, there is disclosed in section view a machine according to an embodiment of the invention. The machine comprises a pair of crushing rolls 11, 12. The rolls are identical and typically between 1–3 m long and have a diameter of between 500–1000 mm. Each crushing roll is formed with a peripheral shell which comprises a series of annular bands, each band being approximately 250 mm wide and being in a side-by-side relationship. This arrangement is known. The rolls are spaced apart sufficiently to allow material to be crushed between the rolls, this being a centre sizing process. The rolls are mounted for rotation by any conventional means. The rolls rotate at a speed of approximately 180 RPM and can crush approximately 500 tonnes of material each hour.

Adjacent each roll 11, 12 is a side plate 13, 14 but the side plates are used only with the side crushing action which will be described below.

Figure 2:
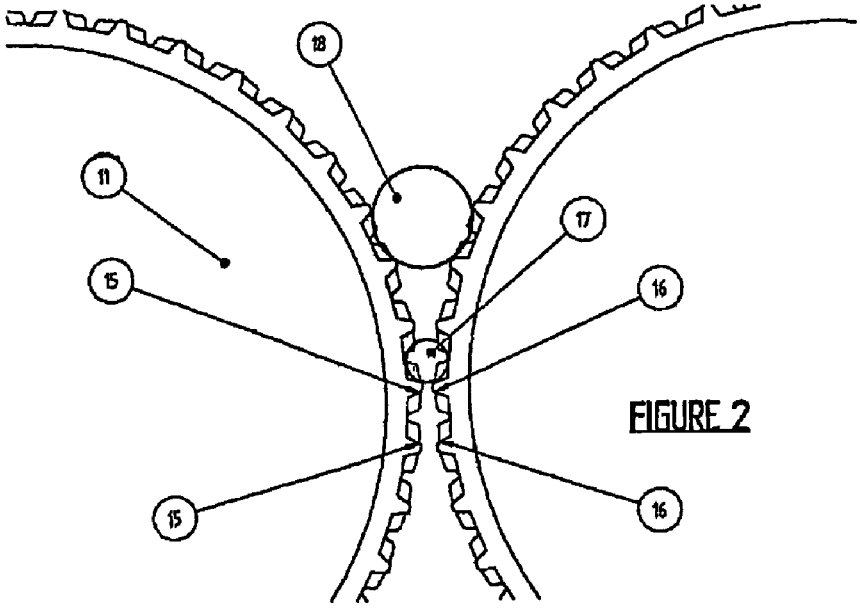
FIG. 2. Illustrates a close-up view of the centre crushing operation.

Referring to FIG. 2 there is illustrated a close-up view of the centre crushing action. Each roll 11, 12 is provided with peripheral teeth and teeth on each roll are identical. The teeth are relatively short and stubby compared to the teeth of conventional centre crushing rolls, and typically have a length of approximately 15 mm. Therefore, in order to allow material to be crushed to a reasonably large particle size, rolls 11, 12 are arranged in the manner illustrated in FIG. 2 such that the teeth 15 on one of the rolls are aligned with the teeth 16 on the other roll. In this manner, the adjacent teeth 15 align with adjacent teeth 16 to define a "cavity" 17 which determines the particle size of the material which passes between the rolls. Thus, initially material of a larger size 18 begins to pass between the rolls and is progressively crushed until it approximates the size of the cavity 17. The cavity in the embodiment is such that the material is crushed to a size of approximately 40 mm. It should be appreciated that this can vary.

Figure 3:
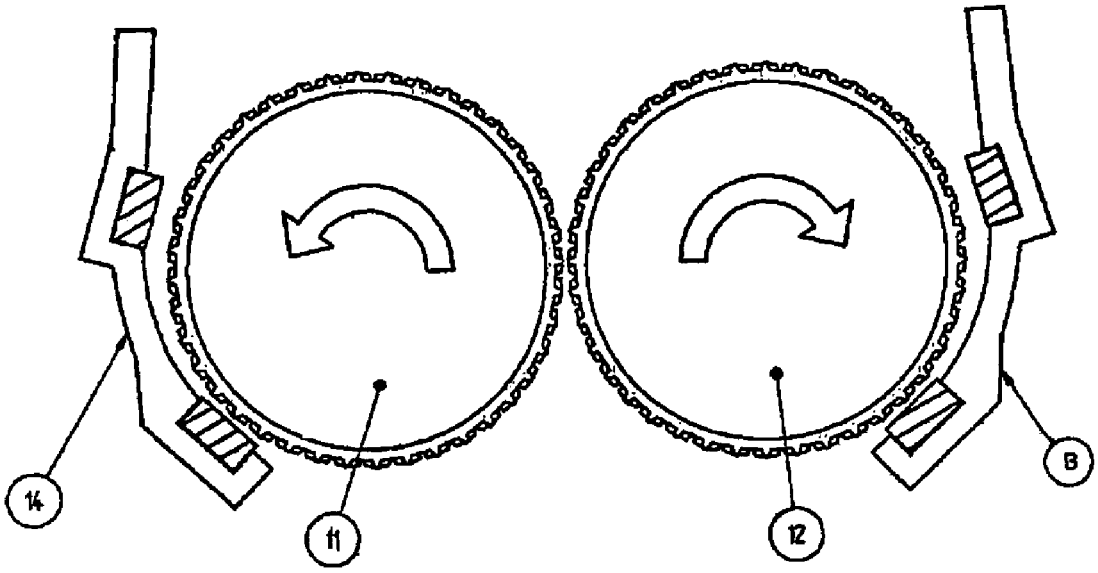
FIG. 3. Illustrates a side crushing operation

Referring to FIG. 3 there is illustrated a side crushing or side sizing configuration. The machine is the same and it is not necessary to remove or replace or even adjust rolls 11, 12. All that is required is to reverse the rotation of the rolls such that the rolls rotate away from each other.

Side plates 13, 14 are provided to assist in the crushing action as the crushing occurs between a roll and the respective side plate. Each side plate 13, 14 can be moved towards the respective roll when side crushing is required, and can be moved away from the respective roll (see the position of FIG. 1) when centre sizing is required.

Figure 4:
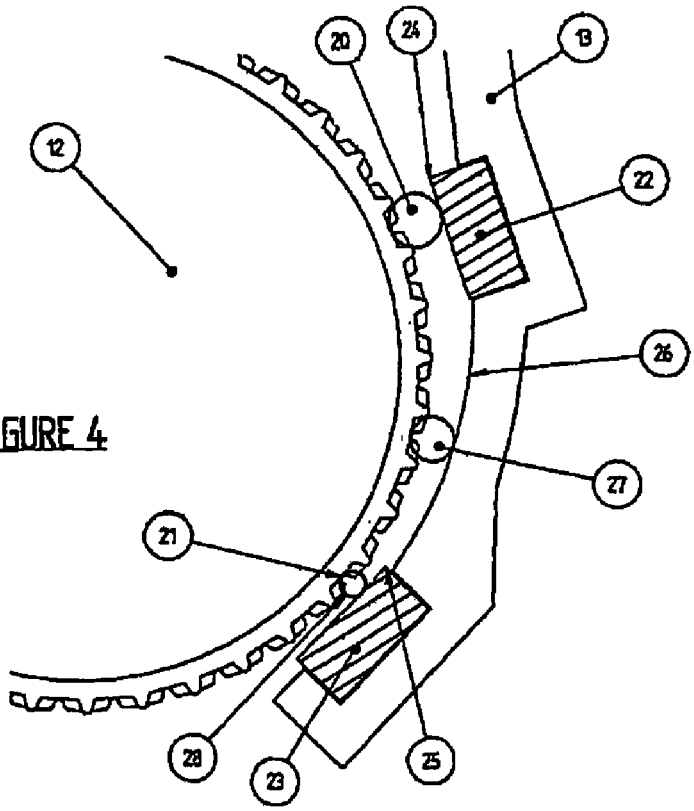
FIG. 4. Illustrates a close-up view of the side crushing operation.

Referring to FIG. 4 it can be seen how larger particles 20 pass between roll 12 and side plate 13. As the particles move downwardly, the particles are progressively crushed or sized to approximately 25 mm (see particle 21) which is the minimum distance between the side plate 13 and roll 12.

More specifically, the side plate 13 contains or supports a pair of wear blocks 22, 23. These blocks provide corners or edges 24, 25 to promote sizing. Thus, corner 24 provide an initial immediate reduction in particle size from a fairly large size to a size of approximately 66 mm. The particle then passes through a relatively smooth wall zone 26 on side plate 13 which progressively but less aggressively reduces the size of the particle from about 66 mm to approximately 30–40 mm (see particle 27). Corner 25 on wear block 23 provides another aggressive reduction in size of the particle to approximately 25 mm (see particle 28). At this stage, the particle is sized between adjacent teeth on roll 12 and the face of wear block 23.

The "stubby" teeth on roll 12 are required to provide a good side sizing operation. The same teeth can be used for centre sizing by aligning the rolls such that the teeth on one roll align with the teeth on the other roll to provide a "cavity" which is larger and therefore provides a larger particle size.

Figure 5:
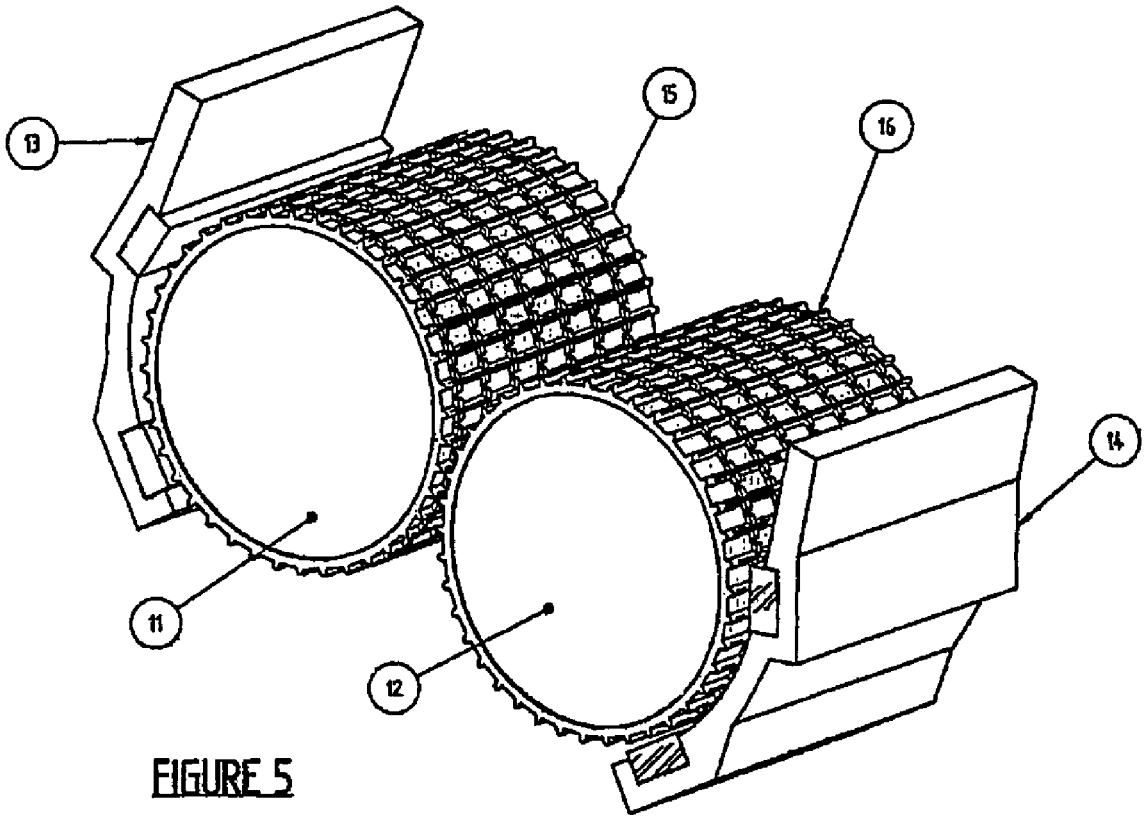
FIG. 5. Illustrates an perspective view of part of the machine.

FIG. 5 provides a perspective view of the machine.

Figure 6:
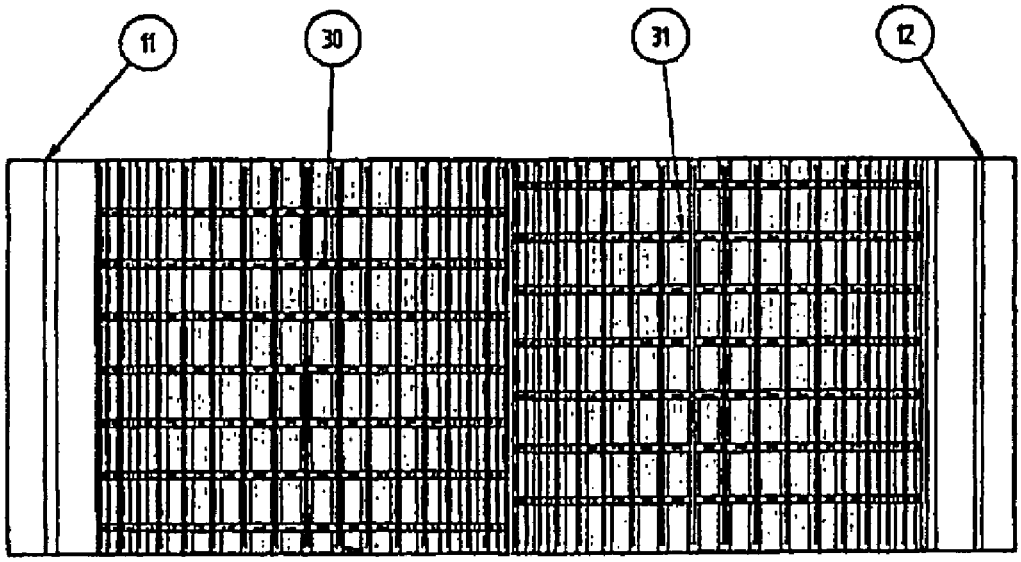
FIG. 6. Illustrates a plan view of the crushing rolls showing the offset arrangement.

FIG. 6 provides a plan view of the machine and in this figure there is more clearly illustrated the offset arrangement between the rolls and illustrates the circumferential rings 30, 31 which are offset between the rolls to cut the crushed product into suitable lengths.

The machine can provide product of different particle size merely by reversing the direction of travel of the rolls and by bringing the side plates towards the rolls or away from the rolls depending on whether side crushing or centre crushing is required. There is no need to adjust the spacing between the rolls, and there is no need to replace the rolls. A separate machine is not required.

It should be appreciated that various other changes and modifications can be made to the embodiment described without departing from the spirit and scope of the invention.

The invention claimed is:

1. A dual product sizing machine, the machine comprising a pair of crushing rolls, the rolls being rotatable towards each other and away from each other each roll being provided with an array of teeth, and a side sizing plate which is positioned adjacent the outer side of at least one of the crushing rolls, whereby rotation of the rolls towards each other allows material to pass between the rolls to be crushed to a first size, and rotation of the rolls away from each other allows material to pass between at least one of the rolls and the side plate to be crushed to a second size.

2. The machine as claimed in claim 1, wherein the crushing rolls have a length of between 1–3 m, and a diameter of between 500–1000 mm.

3. The machine as claimed in claim 2, wherein the crushing rolls comprises a shell that is fitted to a central body, the shell comprising separate segments that are annular and have a width of between 200–300 mm.

4. The machine as claimed in claim 3 wherein both rolls are driven.

5. The machine as claimed in claim 4, wherein the rolls rotate at between 100–300 RPM.

6. The machine as claimed in claim 5, wherein the crushing rate between the rolls is between 100–1000 tonnes per hour.

7. The machine as claimed in claim 1, wherein the crushing teeth are identical on each roll.

8. The machine as claimed in claim 7, wherein the crushing teeth have a tooth length of between 10–20 mm.

9. The machine as claimed in claim 1, wherein the rolls are positioned such that the teeth on one of the rolls are in line with the teeth on the other roll during centre crushing.

10. The machine as claimed in claim 1, wherein a pair of said side plates are provided with a said side plate being positioned along the outer wall of each roll.

11. The machine as claimed in claim 10, wherein the side plates comprise elongated plate members.

12. The machine as claimed in claim 11, wherein the side plates are mounted for movement towards and away from the respective roll.

13. The machine as claimed in claim 1, wherein the side plates contains at least one wear blocks which functions to provide an edge to promote sizing.

14. The machine as claimed in claim 1, which crushes material to a size of approximately 40 mm during centre crushing, and a smaller size of approximately 25 mm during side crushing.

* * * * *